US005998716A

United States Patent [19]

Marquez et al.

[11] Patent Number: 5,998,716

[45] Date of Patent: Dec. 7, 1999

[54] IMPACT RESISTANT MARCHING TOM TOM DRUM HEAD

[75] Inventors: Ronald G. Marquez, Mission Viejo; Roy Burns, Fullerton, both of Calif.

[73] Assignee: Aquarian Accessories Corporation, Anaheim, Calif.

[21] Appl. No.: 09/060,091

[22] Filed: Apr. 13, 1998

[51] Int. Cl.[6] ..... G10D 13/02

[52] U.S. Cl. ..... 84/411 P; 84/411 M

[58] Field of Search ..... 84/411 P, 411 R, 84/411 M, 414

[56] References Cited

U.S. PATENT DOCUMENTS 4,798,121 1/1989 Donohoe ..... 84/414

*Primary Examiner*—Robert E. Nappi
*Assistant Examiner*—Shih-yung Hsieh
*Attorney, Agent, or Firm*—William L. Chapin

[57] ABSTRACT

A drumhead particularly adapted for use on tom tom drums used in marching bands has an impact resistant protective overlay located asymmetrically on a tone producing membrane. The protective overlay has a generally symmetrical ovoidal shape, and is located on that semi-circular region of a drumhead most likely to be impacted by a beater wielded by a drummer having a plurality of tom tom drums arrayed on an arc in front of the drummer.

20 Claims, 3 Drawing Sheets

IMPACT RESISTANT MARCHING TOM TOM DRUM HEAD

BACKGROUND OF THE INVENTION

A. Field of the Invention

The present invention relates to musical instruments of the type classified as percussion instruments such as drums which are used in bands. More particularly, the invention relates to an improved drum head construction for tom tom drums used in marching bands.

B. Description of Background Art

Drum types used by musicians playing in marching bands include bass drums, modified kettle drums, and marching tom tom drums. The latter consist of a generally cylindrically-shaped drum shell and a drum head consisting of a thin membrane held in tension over the upper end of the shell. One or more of such drums are attached to a carrier frame and harness which is supported by the drummer. In the usual configuration, one or two pairs of tom toms are positioned in front of a drummer in laterally spaced apart positions along an arc centered on the drummer. Thus located, the batter heads of the tom toms, which are typically tuned to different fundamental pitches, are struck by the drummer in an alternating sequence to produce drum beats having different fundamental vibration frequencies, or tones.

Marching tom tom drums of the type described above are usually played with hard mallets. For that reason, tom toms drums are usually fitted with two-ply batter heads which provide the durability necessary to withstand the impacting force of the mallets. Laminated tom tom drum heads using one or more plies adhered to the primary, tensioned tone-producing membrane of a drumhead provide a reasonably long useful life. However, laminating the entire drumhead results in a diminished sound quality which is substantially different from that achievable with an unlaminated drumhead. In response to this and other limitations inherent in prior art laminated drum heads, U.S. Pat. No. 4,798,121, which has the same assignee as the present application, disclosed an Impact Resistant Drumhead which employs a protective overlay consisting of two sheets or laminations of woven synthetic plastic fibers which are coated with a synthetic plastic material. The two sheets of the overlay are cross-laminated together with their woof directions perpendicular to one another. The overlay is adhered to the upper surface of a central concentric region of the tone-producing membrane of the drumhead, which is made of a stretched plastic film, thereby increasing the impact resistance of that region of the drumhead sheet beneath the overlay. The plastic coating on the upper surface of the upper lamination enhances impact resistance, and also results in a crisp impact sound when struck by a drumstick. Moreover, localizing the extent of the impact resistant overlay to a central portion of the drumhead minimizes effects upon the sound volume output and frequency response of the drumhead.

The present invention was conceived of to provide a drumhead for tom tom type drums which has enhanced impact resistance, while minimally altering the acoustical properties achievable with a single ply or double ply drumhead.

OBJECTS OF THE INVENTION

An object of the present invention is to provide a drumhead construction which has enhanced resistance to denting or breakage by vigorous battering of the drumhead by drumsticks or mallets.

Another object of the invention is to provide an impact resistant drumhead having a protective overlay localized to the intended area of impact of the drumhead by drumsticks or mallets.

Another object of the invention is to provide an impact resistant drumhead having a protective overlay asymmetrically located with respect to the perimeter of the drumhead.

Another object of the invention is to provide a circular impact resistant drumhead having a protective overlay which is asymmetrically offset from the center of the drumhead.

Another object of the invention is to provide a drumhead for marching tom toms which has an ovoidal-shaped, impact resistant protective overlay located generally between the center and the periphery of the drumhead.

Another object of the invention is to provide a marching tom tom drumhead provided with an impact resisting overlay which has a generally transversely elongated ovoidal shape including an outer convex semi-circular semi-perimeter concentric with and inwards of a segment of the drumhead rim which is intended to be positioned near a drummer, and an inner convex semi-circular semi-perimeter which is mirror symmetric with the outer semi-perimeter.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, we do not intend that the scope of my exclusive rights and privileges in the invention be limited to details of the embodiments described. We do intend that equivalents, adaptations and modifications of the invention reasonably inferable from the description contained herein be included within the scope of the invention as defined by the appended claims.

SUMMARY OF THE INVENTION

Briefly stated, the present invention comprehends an improved construction for drum heads, particularly those used on marching tom toms. According to the present invention, a drumhead for marching tom tom drums is provided with an impact resistant overlay which is located generally in that region of the drumhead which is most frequently impacted by mallets swung by a drummer against a plurality of tom toms supported along an arc-shaped line in front of the drummer. An impact resistant marching tom tom drumhead according to the present invention comprises a circular tone producing membrane which has a protective overlay adhered to its upper surface, this overlay being offset from the center of the membrane. The protective overlay has an inner arcuately curved convex edge located near the center of the circular drumhead membrane. This edge, which comprises a semi-perimeter of the overlay, has a generally circular arc shape, the center of curvature of which is located between the center of the drumhead and that portion of the drumhead near the drummer. The overlay also has an outer semi-perimeter edge which is generally mirror symmetric with the inner semi-perimeter of the overlay, located concentrically a short distance inwards from the drumhead rim, proximate the drummer. The center of curvature of the outer semi-perimeter of the overlay is located substantially at the center of curvature of the drumhead.

As described above, the overlay according to the present invention has a shape approximating the side view of a football, with the inner or distal semi-perimeter edge of the overlay, distant from the drummer, corresponding to the upper edge of the football, i.e., arcing downwardly or outwardly from a location inwards or above the center of the drumhead. The outer proximal semi-perimeter edge of the overlay, corresponding to the lower edge of a football, is concentric with, and located a short distance inwards of a lower peripheral edge of that portion of the drumhead rim near to the drummer. With this shape and location, the impact resistant overlay covers the usual impact region of mallets wielded by a drummer whose arms are directed in a generally radially disposed direction to an array of tom tom drums lying on an arc in front of the drummer. Thus, only those portions of a tom tom drumhead which are likely to be impacted by a mallet are protected by the impact resistant overlay, minimizing changes in the quality and volume of sound emitted by the vibrating drumhead. In the preferred embodiment, the impact resistant overlay is made of one or two plies of a plastic woven cloth.

DESCRIPTION OF THE PREFERRED EMBODIMENTS

Figure 1:
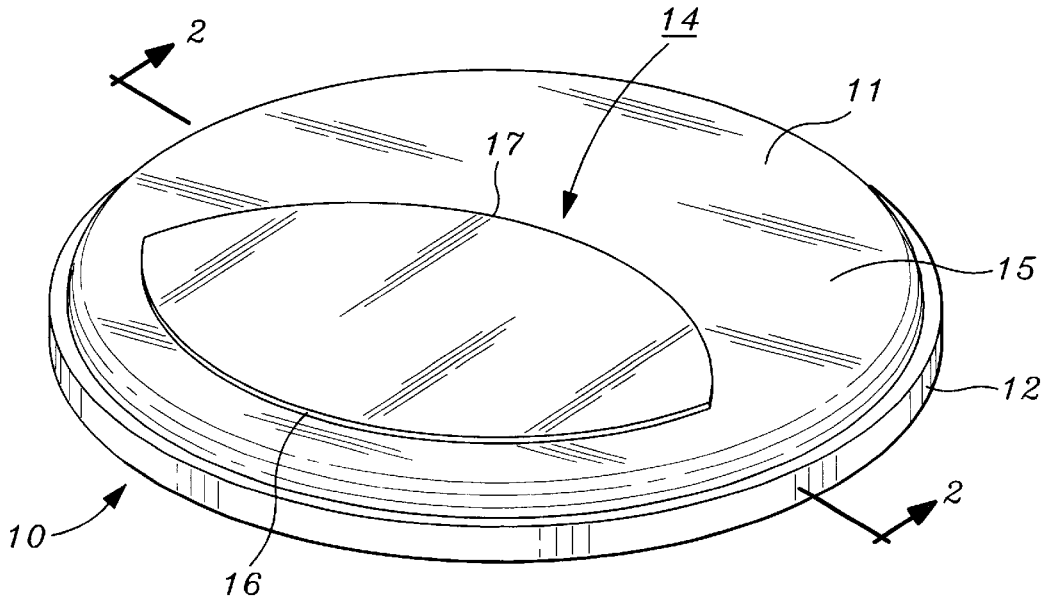
FIG. 1 is a perspective view of an impact resistant tom tom drumhead according to the present invention.
Figure 4:
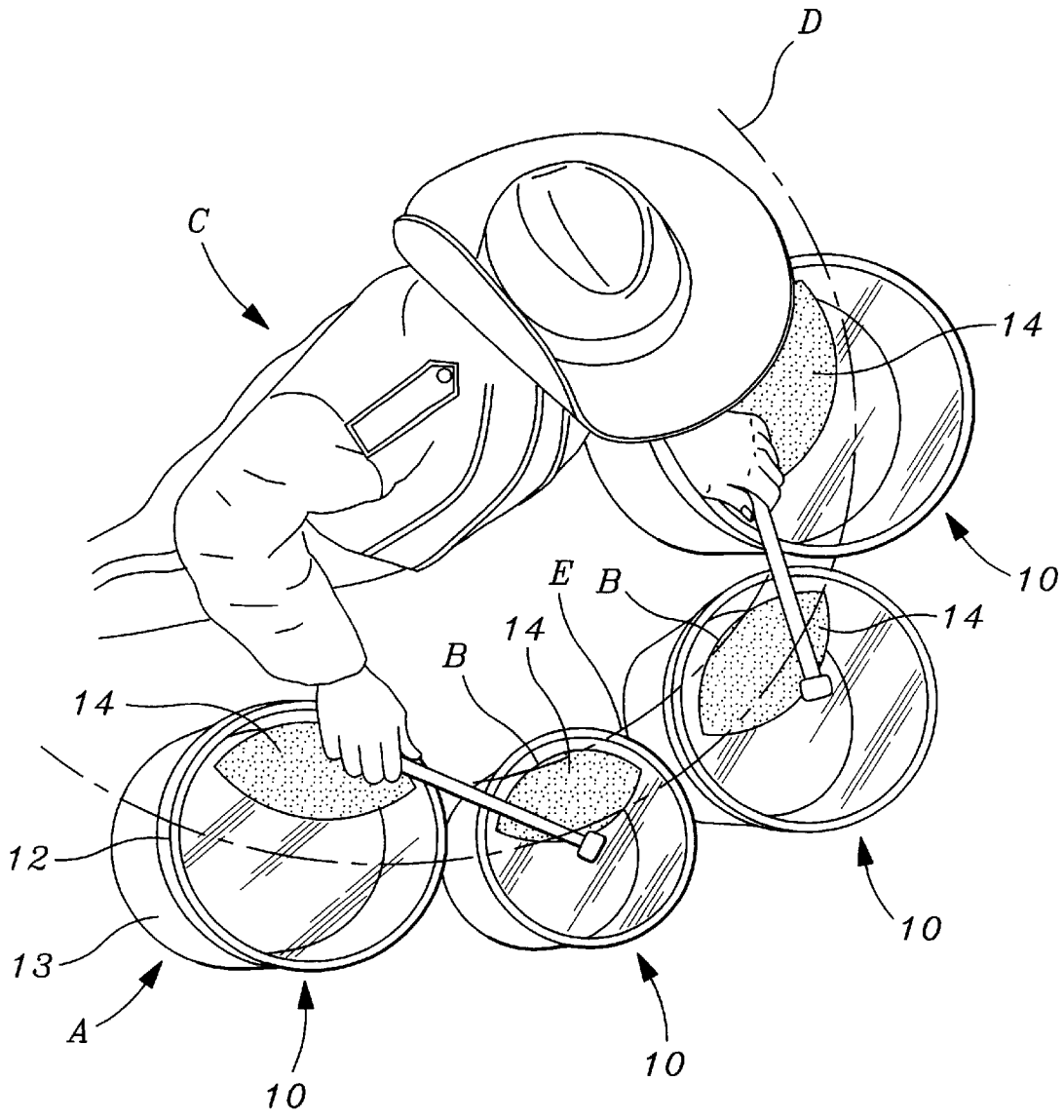
FIG. 4 is a perspective view showing a plurality of tom tom drums fitted with drumheads of the type shown in FIG. 1 according to the present invention, the drums being arrayed in front of a drummer.

FIG. 1 illustrates an impact resistant marching tom tom drumhead 10 according to the present invention. As shown in FIG. 1, drumhead 10 includes a tone producing member consisting of a circular membrane made of a thin, flexible material and fastened near its outer circumferential periphery to a rigid circular ring or hoop 12. Drumhead 10 is adapted to fit over an open end of a cylindrical drum shell 13, as shown in FIG. 4, and held in place by clamps which tension the drumhead against the annular end wall of the shell.

Circular tone-producing membrane 11 of drumhead 10 may be fabricated from a variety of materials. The preferred material for drumhead membrane 11 according to the present invention is a condensation polymer of ethylene glycol and terephthalic acid which has been formed into a film approximately 0.010 inch thick by biaxial stretching. This film material is available commercially from the E. I. Dupont de Nemours & Company, Inc., under the trademark MYLAR.

As shown in FIG. 1, drumhead 10 according to the present invention includes an impact resisting protective overlay 14 adhered to the upper surface 15 of drumhead membrane 11.

As will be described in more detail below, protective overlay 14 does not cover the entire upper surface 15 of drumhead membrane 11. Instead, overlay 14 covers only that portion of drumhead membrane 11 which is likely to be impacted by a mallet wielded by a drummer. As shown in FIG. 4, for a plurality of tom tom drums A arrayed in an arc in front of a drummer, the upper or inner perimeter of the impact region B of the drumhead 10 fitted to each tom tom has the shape of circular arc D centered approximately at the elbow of a drummer C. The lower or outer perimeter limit of mallet impact region B is that segment of rim 12 adjacent to the drummer. However, since rim shots are not made by mallets on tom tom drums, the practical outer limit of impact region B would be a circular arc E concentric with and inwards of drumhead rim 12.

Figure 2:
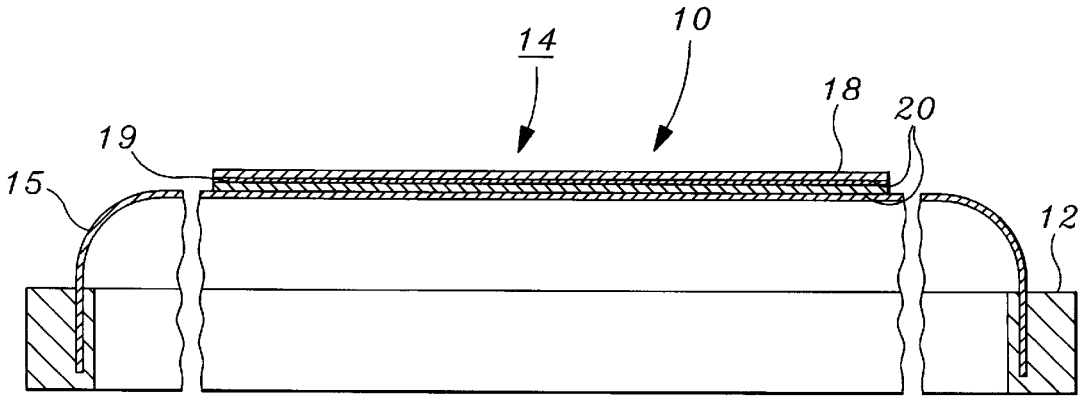
FIG. 2 is a cross sectional view of the drumhead of FIG. 1, taken along line 2—2.
Figure 3:
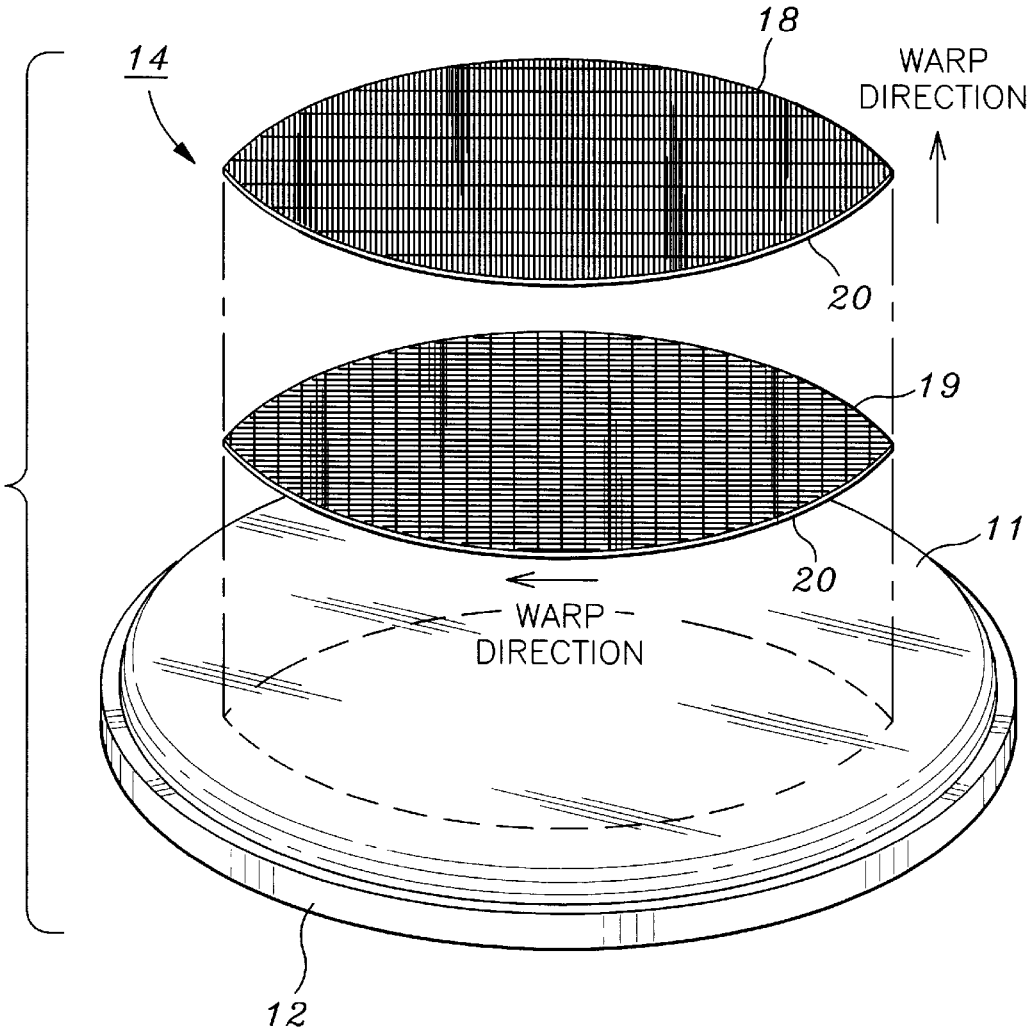
FIG. 3 is an exploded view of the drumhead of FIG. 2, showing how an overlay portion thereof is fabricated.

The construction of impact resistant marching drumhead 10 may be best understood by referring to FIGS. 2 and 3 in addition to FIG. 1. In particular, the shape and location of impact resistant overlay 14, relative to drumhead 10, may be best understood by referring to FIG. 1, while the structure of the insert may best be understood by referring to FIGS. 2 and 3.

As shown in FIG. 1, impact resistant overlay 14 may be seen to have a modified oval shape, formed by the intersection of two circular arcs. Overlay 14 is located generally between the center of drumhead 10 and that portion of rim 12 of the drumhead proximate a drummer, as shown in FIG. 4. Thus, as shown in FIG. 1, overlay 14 has a lower, or outer semi-perimeter edge 16 having the shape of circular arc approximately concentric with rim 12 of drumhead 10. Lower circular arc-shaped edge 16 of overlay 14 has a center of curvature located near the geometric center of drumhead 10.

Referring still to FIG. 1, it may be seen that overlay 14 has an upper, or inner semi-perimeter edge 17 which is approximately mirror symmetric with lower, outer semi-perimeter edge 16. Thus, upper, inner semi-perimeter edge 17 has the shape of a circular arc which extends symmetrically beyond the geometric center of drumhead 10, and which has a center of curvature located between the center and rim 12 of the drumhead. As shown in FIG. 1, the outline shape of overlay 14 approximates the side elevation view of a football, with upper, distal edge 17 of the overlay corresponding to the upper edge of the football, and lower, proximal edge 16 of the overlay corresponding to the lower edge of the football.

As shown in FIGS. 2 and 3, impact resistant overlay 14 preferably comprises a laminated structure consisting of an upper lamination 18 and a lower lamination 19. Alternatively, the overlay may consist of a single lamination, such as lower lamination 19.

In the preferred embodiment, both upper lamination 18 and lower lamination 19 of overlay 14 are fabricated from the same material, namely, a cloth or fabric woven of synthetic plastic fibers, which is coated with or impregnated with plastic.

Referring still to FIGS. 3 and 4, it may be seen that the fabric strands of upper lamination 18 of overlay 14 are angled relative to the strands of lower lamination 19 of the overlay.

To understand why woven overlay laminations 18 and 19 are so arranged, it should be kept in mind that the orientation of the strands or fibers of a woven fabric is controlled by the weaving process, in which fibers stretched tightly in a lengthwise direction, parallel to the processing or rolling direction of fabrication, are called the warp. Threads taken together which run from side to side are commonly called the woof, or, more correctly, the weft. Usually, woven fabrics have substantially different tensile strength and tear resistance in the warp and woof directions. Typically, a woven fabric has substantially greater tensile strength and resistance to tearing from forces applied parallel to the woof direction. Thus, in embodiments of the present invention employing a laminated protective overlay 14, upper overlay lamination 18 and lower lamination 19 are preferably oriented with their warp directions perpendicular to one another. This construction results in overlay 14 having a mallet impact resistance which is more uniformly great for various polar glancing angles of a mallet relative to the overlay.

In an example embodiment of a drumhead 10 provided with a protective overlay 14 having the novel shape and location depicted in FIG. 1 and described above, upper overlay lamination 18 and lower overlay lamination 19 were made from a plastic woven cloth having a thickness of 0.006 inch and available under the trademark FLEXMARK PC 600-W from the Flexcon Corporation, Flexcon Industrial Park Rd., Spencer, Mass. 01562. That material has a weight of approximately 2.8 oz. Per square yard and is supplied with a pressure sensitive adhesive layer 20 on one surface. Various other woven and impregnated plastic fabrics are considered to be useful in the fabrication of overlay 14. These include synthetic plastic fabrics woven of polyester fibers and impregnated with polyvinyl chloride resin.

Various pressure-sensitive adhesives such as acrylic adhesive may be used to adhere overlay 14 to upper surface 15 of drumhead membrane 11. For laminated embodiments of overlay 14, those adhesives may also be used to adhere laminations 18 and 19 together.

Overlay 14, as described above, protects tone-producing membrane 11 of drumhead 10 from denting or suffering even more catastrophic damage, such as cracking or tearing, when impacted by a drumstick or mallet. The novel "football" shape of overlay 14, and its novel location, offset from the center of drumhead 10, protects drumhead 10 from impact damage, while minimizing the area of the drumhead covered by overlay. Minimizing the area covered by overlay 14 minimizes alteration of tone quality and sound volume of drumhead 10 as compared to a drumhead not provided with an overlay.

An example embodiment of drumhead 10 was constructed in which the outer diameter of hoop 12 was 12½ inches, in which the useful battering region of drumhead tone-producing membrane 11 had a diameter of about 11¾ inches. In this example, outer, lower semi-perimeter edge 16 of overlay 14 had a radius of 5⅛ inches, and had a center of curvature located approximately at the geometric center of the drum, thus locating edge 16 about ¾ inch inwards of and concentric with the outer playing edge of drumhead membrane 11. Also, in the example embodiment, upper, or inner edge 17 of overlay 14 had a circular arc shape with a radius of 5⅛ inches, the center of curvature of the arc lying on a transverse bisector of the overlay about 1¼ inches inwards from lower edge 16 of the overlay, thus locating inner edge 17 a maximum distance of about 1¼ inch beyond the geometric center of drumhead 10. With these dimensions, overlay 14 covers less than 50 percent of drumhead membrane 11. Accordingly, it was found that the example embodiment of drumhead 10, provided with protective overlay 14, had a tone quality and sound volume output which were only slightly diminished with respect to the properties of a drumhead having an unprotected tone producing membrane 11.

What is claimed is:

1. A drumhead comprising;

a. an annular ring-shaped rim hoop, b. a thin circularly-shaped flexible sound-producing membrane fastened at the periphery thereof to said hoop, said membrane tensionable against an annular edge wall of a drum shell, whereby said membrane may be induced to emit sound-producing vibrations by impacting said membrane with a beater, and c. a protective overlay covering a portion of said sound-producing membrane to protect said membrane from impact damage by said beater, said overlay being offset from center of said membrane such that impacts on said membrane by said beater welded by a drummer located in a position radially offset from said center of said drum are substantially confined to said overlay-covered portion of said membrane.

2. The drumhead of claim 1 wherein a substantial portion of said overlay lies in a single semi-circular portion of said membrane.

3. The drumhead of claim 2 wherein said overlay is further defined as having a first, radially outwardly located arcuately curved proximal peripheral edge located radially inwards of a position of said drumhead hoop intended to be positioned proximate a drummer, said edge having the same curvature polarity as said proximal portion of said drumhead hoop.

4. The drumhead of claim 3 wherein said overlay is further defined as having a second, radially inwardly located, arcuately curved distal peripheral edge located radially inwardly toward the center of said membrane from said first edge, said second edge having a curvature polarity opposite that of said first peripheral edge.

5. The drumhead of claim 4 wherein said proximal peripheral edge is further defined as being convexly outwardly curved towards said portion of said hoop proximate said drummer.

6. The drumhead of claim 5 wherein said proximal peripheral edge of said overlay is further defined as having a center of curvature located near the center of said membrane.

7. The drumhead of claim 6 wherein said second, distal peripheral edge of said overlay is further defined as being convexly curved away from said portion of said hoop proximate said drummer.

8. The drumhead of claim 7 wherein said second, distal peripheral edge of said overlay is further defined as having a center of curvature located between said first, proximal peripheral edge of said overlay and the center of said membrane.

9. The drumhead of claim 8 wherein said first, proximal peripheral edge of said overlay is further defined as having the shape of a segment of a circular arc.

10. The drumhead of claim 9 wherein said second, distal peripheral edge of said overlay is further defined as being symmetric with respect to said first, proximal peripheral edge, along a symmetry plane lying along a laterally disposed chord joining opposite ends of said first, proximal peripheral edge of said overlay.

11. An improvement in a drumhead comprising an annular ring-shaped rim hoop, and a thin circularly-shaped flexible sound-producing membrane fastened at the periphery thereof to said hoop, said membrane tensionable against an annular edge wall of a drum shell, whereby said membrane may be induced to emit sound-producing vibrations by impacting said membrane with a beater, the improvement comprising:

a protective overlay covering a portion of said sound-producing membrane to protect said membrane from impact damage by said beater, said overlay being offset from center of said membrane such that impacts on said membrane by said beater welded by a drummer located in a position radially offset from said center of said drum are substantially confined to said overlay-covered portion of said membrane.

12. The improvement of claim 11 wherein a substantial portion of said overlay lies in a single semi-circular portion of said membrane.

13. The improvement of claim 12 wherein said overlay is further defined as having a first, radially outwardly located arcuately curved proximal peripheral edge located radially inwards of a position of said drumhead hoop intended to be positioned proximate a drummer, said edge having the same curvature polarity as said proximal portion of said drumhead hoop.

14. The improvement of claim 13 wherein said overlay is further defined as having a second, radially inwardly located, arcuately curved distal peripheral edge located radially inwardly toward the center of said membrane from said first edge, said second edge having a curvature polarity opposite that of said first peripheral edge.

15. The improvement of claim 14 wherein said proximal peripheral edge is further defined as being convexly outwardly curved towards said portion of said hoop proximate said drummer.

16. The improvement of claim 15 wherein said proximal peripheral edge of said overlay is further defined as having a center of curvature located near the center of said membrane.

17. The improvement of claim 16 wherein said second, distal peripheral edge of said overlay is further defined as being convexly curved away from said portion of said hoop proximate said drummer.

18. The improvement of claim 17 wherein said second, distal peripheral edge of said overlay is further defined as having a center of curvature located between said first, proximal peripheral edge of said overlay and the center of said membrane.

19. The improvement of claim 18 wherein said first, proximal peripheral edge of said overlay is further defined as having the shape of a segment of a circular arc.

20. The improvement of claim 19 wherein said second, distal peripheral edge of said overlay is further defined as being symmetric with respect to said first, proximal peripheral edge, along a symmetry plane lying along a laterally disposed chord joining opposite ends of said first, proximal peripheral edge of said overlay.

* * * * *